United States Patent [19]

Masuda

[11] 4,440,197

[45] Apr. 3, 1984

[54] SHUTTLELESS LOOM

[75] Inventor: Yoshinori Masuda, Kurobe, Japan

[73] Assignee: Yoshida Kogyo K.K., Tokyo, Japan

[21] Appl. No.: 406,547

[22] Filed: Aug. 9, 1982

Related U.S. Application Data

[63] Continuation of Ser. No. 160,166, Jun. 17, 1980.

[30] Foreign Application Priority Data

Jun. 22, 1979 [JP] Japan ..... 54-79502

[51] Int. Cl.[3] ..... D03D 47/42

[52] U.S. Cl. ..... 139/431

[58] Field of Search ..... 139/431, 432

[56] References Cited

U.S. PATENT DOCUMENTS

| | | | |
|---|---|---|---|
| 2,130,636 | 9/1938 | Clutsom | 139/431 |
| 4,027,703 | 6/1977 | Diesner | 139/431 |
| 4,344,463 | 8/1982 | Muller et al. | 139/432 |

FOREIGN PATENT DOCUMENTS

| | | | |
|---|---|---|---|
| 2519612 | 11/1975 | Fed. Rep. of Germany | 139/431 |

*Primary Examiner*—Henry Jaudon

*Attorney, Agent, or Firm*—Robert E. Burns; Emmanuel J. Lobato; Bruce L. Adams

[57] ABSTRACT

A shuttleless loom for weaving a fabric comprises a weft inserting device for inserting a pair of successive loops of weft yarns simultaneously through respective superimposed warp sheds from one side thereof, and a selvedge-forming device arranged along the other side of the warp sheds for forming a knitting selvedge at one edge of the fabric being woven. The weft inserting device reciprocates along a first arcuate path in a first plane extending substantially parallel to the fabric. The selvedge-forming device reciprocates along a second arcuate path in a second plane extending substantially perpendicularly to the first plane so as to pass through a single loop of one of the weft yarns and catch the other weft yarn projecting out of the warp sheds.

3 Claims, 8 Drawing Figures

SHUTTLELESS LOOM

This is a continuation of application Ser. No. 160,166, filed June 17, 1980.

BACKGROUND OF THE INVENTION

1. Field of the Invention

The present invention relates to a shuttleless loom for weaving a narrow fabric using more than one weft yarn and having a knitted selvedge formed of one weft yarn only.

2. Prior Art

British Pat. No. 1,460,619 published Jan. 6, 1977 discloses a shuttleless loom of the type described which comprises a pair of juxtaposed upper and lower weft inserters reciprocable in unision through their respective sheds to carry loops of weft yarns across the width of their sheds, and a selvedge-forming latch needle arranged alongside of the sheds for reciprocating movement through a loop of the weft yarn carried by the upper weft inserter. A weft diverter or lifter is positioned between the upper and lower weft inserters and is operated in timed relation with the weft inserters and the selvedge-foaming latch needle for moving the weft yarn carried by the lower weft inserter into a position in which it can be received or picked up by the latch needle, to thereby allow the latch needle to produce a knitted selvedge of the one weft yarn only. The diverter, however, requires a separate and complicated driving mechanism. Moreover, the diverter imposes excessive degree of tension on the weft yarn being lifted up, with the result that the structure of a fabric being woven tends to be uneven, or the lifted weft yarn is liable to be damaged or sometime broken. The diverter while being rapidly moved up and down tends to miss the weft yarn as it is supplied by the weft inserter so as to picked up by the selvedge-forming needle.

SUMMARY OF THE INVENTION

According to the invention, a shuttleless loom for weaving a fabric comprises means for inserting a pair of successive loops of the weft yarn simultaneously through respective superimposed warp sheds from one side thereof, and means arranged along the other side of the warp sheds for forming a knitted selvedge at one edge of the fabric being woven. The weft-inserting means reciprocates along a first arcuate path in a first plane extending substantially parallel to the fabric being woven. The selvedge-forming means reciprocates along a second arcuate path in a second plane extending substantially perpendicularly to the first plane so as to pass through a single loop of one of the weft yarns and catch the other weft yarn projecting out of the warp sheds.

It is an object of the present invention to provide an improved shuttleless loom which is simple in construction and durable for high-speed operation.

Another object of the invention is to provide a shuttleless loom which can weave a fabric of uniform structure at a high speed without causing a breakage of a weft yarn.

Still another object of the invention is to provide a shuttleless loom having a selvedge-knitting needle which can reliably catch loops of weft yarn.

Many other advantages, features and additional objects of the present invention will become manifest to those versed in the art upon making reference to the detailed description and the accompanying drawings in which a preferred structural embodiment incorporating the principles of the present invention is shown by way of example.

DETAILED DESCRIPTION

Figure 1:
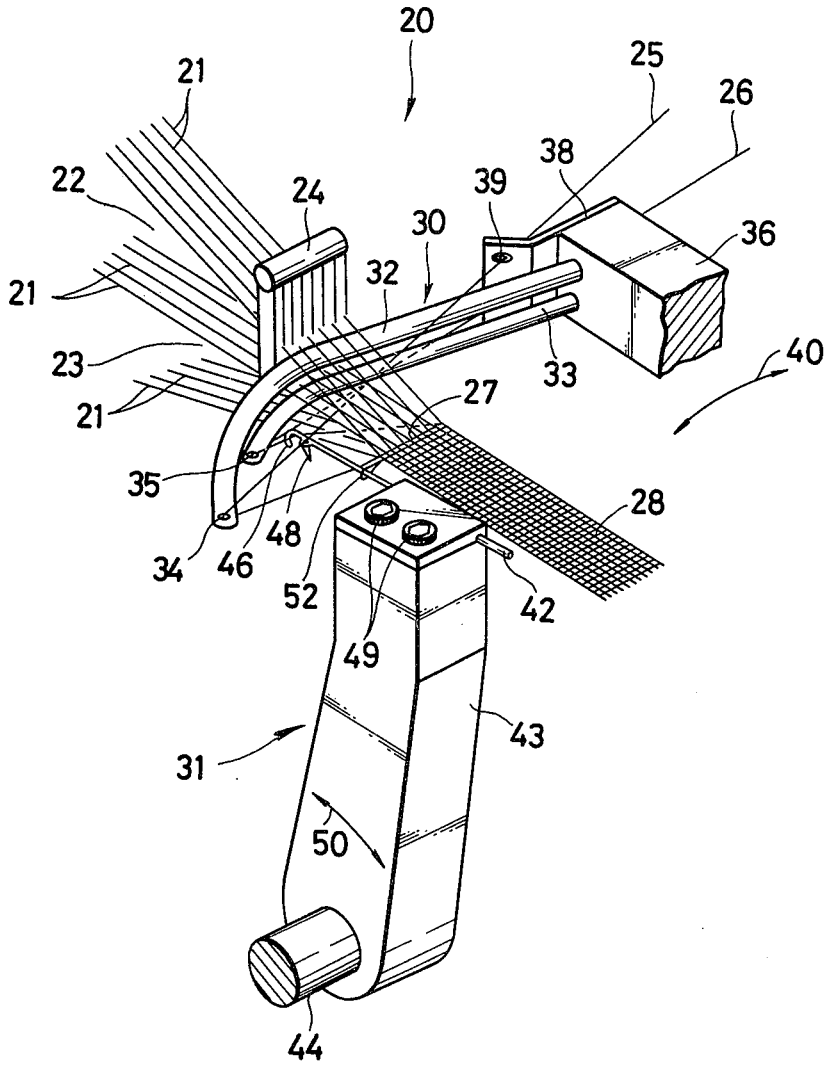
FIG. 1 is a fragmentary perspective view showing a central part of a shuttleless loom constructed in accordance with the present invention.
Figure 2:
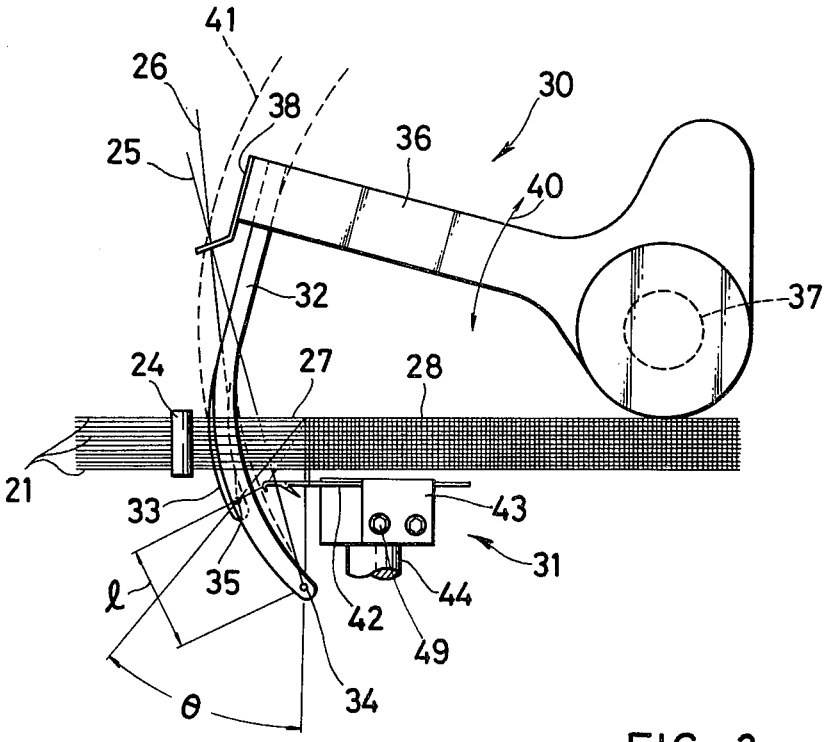
FIG. 2 is a top view of the part of the shuttleless loom shown in FIG. 1.
Figure 3:
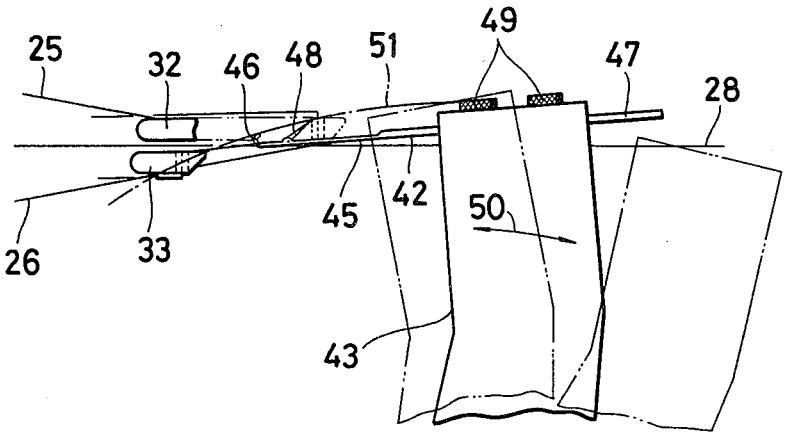
FIG. 3 is an enlarged side elevational view, partly broken away, of the part of the shuttleless loom shown in FIG. 2.

The principles of the present invention are particularly useful when embodied in an apparatus as shown in FIG. 1 through 3 generally indicated by the numeral 20.

The shuttleless loom 20 generally comprises a plurality of heddles (not shown) mounted on a frame for separating three groups of warp yarns 21 to form simultaneously a pair of superimposed warp sheds 22 and 23, a beat-up read 24 pivotable back and forth to beat up inserted weft yarns 25 and 26 against a fell 27 of a fabric 28 being produced, a weft inserting device 30 for placing the weft threads 25,26 simultaneously across their respective warp sheds 22,23 from one side thereof to produce the fabric 28, and a selvedge-forming device 31 for catching and knitting loops of the inserted weft yarns together.

The weft inserting device 30 comprises a pair of spaced upper and lower arcuate fingers 32 and 33 each having a small eye 34, (35) at its free end through which the weft yarn 25 or 26 is supplied from a suitable yarn supply (not shown). Each of the fingers 32,33 is connected at the other end to a free end of an arm 36 which is mounted on a shaft 37 (FIG. 2) rotatably supported on the frame. A bracket 38 is secured to the free end of the arm 36 and has a pair of vertically spaced small guide eyes 39 (only one shown). Preferably, the upper and lower fingers 32 and 33 are arranged in vertically superimposed relation with each other with the upper finger 32 being longer than the lower finger 33. With this arrangement, the weft yarn 25 is fed through the upper eye 39 in the bracket 38, over the upper arcuate finger 32 through the eye 34 therein, thence to the fabric being woven. The weft yarn 26 is supplied from another yarn supply through the lower eye 39 in the bracket 38, under the lower arcuate finger 33, through the eye 35 therein, and thence to the fabric being woven.

Upon rocking movement of the arm 36 in the direction of the arrow 40, each arcuate finger 32,33 reciprocates along a first arcuate path 41 (FIG. 2) in a first plane extending substantially parallel to the fabric 28 being woven. Both of the arcuate fingers 32,33 preferably have substantially the same radius of curvature as that of the first arcuate path 41, the eyes 34,35 being angularly spaced from each other in the first plane by a distance l so that the weft yarn 25,26 supplied through respective eyes 34,35 to the fell 27 jointly define an angle $\theta$ within which the selvedge forming device 31 can move for catching loops of one of weft yarns 26 without interference with the arcuate fingers 32,33.

The selvedge-forming device 31 comprises a knitting needle 42 supported by a rocker arm 43 which is mounted on a shaft 44 which is rotatably supported on the frame. The knitting needle 42 includes a shank 45, a hook 46 at a distal end thereof and a base portion 47 at the other end thereof. The knitting needle 42 shown comprises a latch needle having a latch 48 pivoted to the shank 45 to open and close the hook 46. The base portion 47 is fixed to a free end of the rocker arm 43 by screws 49,49. The rocker arm 43 is reciprocable in the direction of the arrow 50 so as to enable the hook 46 to follow a second arcuate path 51 in a second plane extending substantially perpendicularly to the first plane in which the upper and lower arcuate fingers 32,33 sweep through their respective sheds 22,23.

Figure 4:
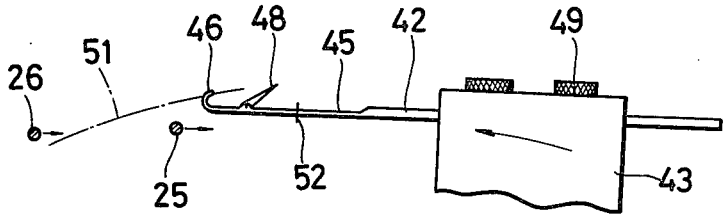
FIGS. 4 through 8 are enlarged side elevational views illustrative of successive movements of a selvedge-forming device and a pair of weft yarns.
Figure 5:
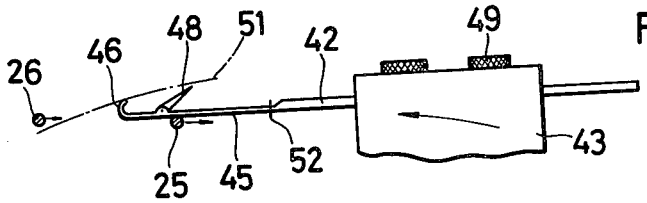
Figure 6:
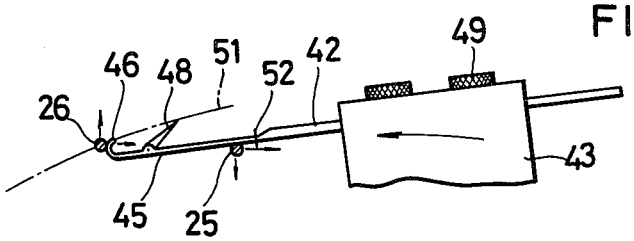
Figure 7:
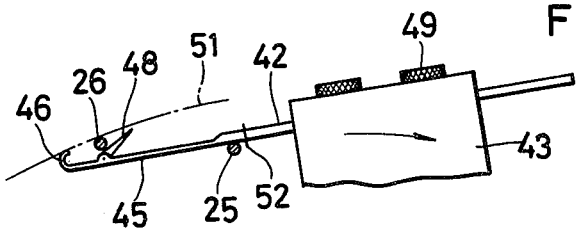
Figure 8:
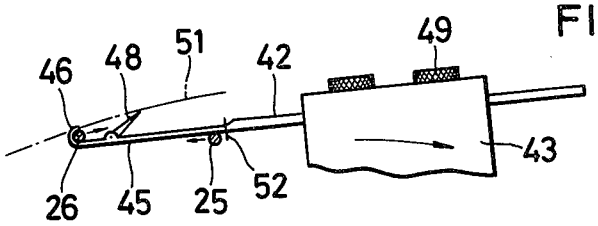

In operation, both of the arcuate fingers 32,33 move simultaneously through their respective sheds 22,23 to carry loops of weft yarns 25,26 across the width of the sheds 22,23. The knitting needle 42 moves from its fully retracted position toward the sheds 22,23 in timed relation with the arcuate fingers 32,33 (FIG. 4). As the knitting needle 42 advances along the second arcuate path 51, it passes through a loop of the weft yarn 25 which is carried by the upper arcuate finger 32 and is inserted between the weft yarn 25 and the weft yarn 26 which is carried by the lower arcuate finger 33 (FIG. 5). The knitting needle 42, on further advancing movement, slightly depresses the weft yarn 25 at the shank 45 thereof and slightly lifts or raises the other weft yarn 26 at its hook 46 which opens upwardly (FIG. 6). At or near the end of the travel of the arcuate fingers 32,33, the weft yarn 26 crosses over the hook 46 of the knitting needle 42 as shown FIG. 7. Then, the knitting needle 42 starts to be withdrawn along its arcuate path 51. As the knitting needle 42 retracts, the weft yarn 26 is caught reliably by the hook 46 and drawn through the previous loop of weft yarn 26 as the latter is slid or cast off the shank 45 of the knitting needle 42 with the latch 48 being closed. Upon completion of one cycle of synchronous operation of the weft inserting device 30 and the selvedge-forming device 31, the reed 24 moves forwardly to beat up the weft yarns 25,26 to form a new fell of the fabric. Thus, only the weft yarn 26 is knitted into a chain of stitches surrounded or wrapped by the unknitted loops of the weft yarn 25.

Although various minor modification may be suggested by those versed in the art, it should be understood that I wish to embody within the scope of the patent warranted hereon, all such embodiments as reasonably and properly come within the scope of my contribution to the art.

What is claimed is:

1. A shuttleless loom for weaving a fabric, comprising:

(a) means for inserting a pair of successive loops of weft yarns simultaneously through respective superimposed warp sheds from a first side thereof, said inserting means comprising a pair of spaced upper and lower arcuate fingers arranged one above the other in superposed relation with each other and reciproable respectively through a corresponding one of said superposed sheds along a first arcuate path in a first plane extending substantially parallel to the plane of the fabric being woven, each of said fingers having at its free end an eye for passage therethrough of one of said weft yarns supplied to the fell of the fabric, means for reciprocating said fingers between a first position in which both of said eyes are on said first side of said warp sheds at a first side of the fabric and a second position in which both of said eyes are beyond a second side of both of said warp sheds at a second side of the fabric, one of said fingers being sufficiently longer than the other so that when said fingers are in said second position said weft yarns supplied through said eyes to said fell jointly define therebetween an angular space in the general plane of the fabric being woven; and (b) means arranged along the second side of said warp sheds for forming a knitted selvedge at one edge of the fabric being woven, said selvedge-forming means including a single knitting needle having at its free end a hook reciprocable in timed relation with said arcuate fingers along a second arcuate path in a second plane extending substantially perpendicularly to said first plane in such a manner that said hook reciprocates within said angular space to pass through a single loop of the weft yarn inserted by said longer finger and to catch and knit only the weft yarn extending freely between the fell of the fabric and the eye of said shorter finger.

2. A shuttleless loom according to claim 1 in which said arcuate fingers have substantially the same radius of curvature as that of said first arcuate path.

3. A shuttleless loom according to claim 1 or 2 in which said fingers are mounted on the free end of an arm which is oscillatable about an axis perpendicular to said first plane, and in which a pair of upper and lower yarn guides are provided respectively at the free end of said arm, said yarns passing through said yarn guides respectively to the eyes at the free ends of said fingers respectively and hence to the fell of the fabric.

* * * * *